US005712002A

United States Patent [19]

Reilly, III

[11] Patent Number: 5,712,002

[45] Date of Patent: Jan. 27, 1998

[54] TELESCOPIC DECORATIVE TREE

[76] Inventor: William P. Reilly, III, 11601 Camp Dr., Dunnellon, Fla. 34432

[21] Appl. No.: 656,011

[22] Filed: May 24, 1996

[51] Int. Cl.[6] ..... A47G 33/06

[52] U.S. Cl. ..... 428/20; 211/196; 362/123

[58] Field of Search ..... 428/18, 19, 20; 211/196, 205; 362/123

[56] References Cited

U.S. PATENT DOCUMENTS

| | | | |
|---|---|---|---|
| 2,289,680 | 7/1942 | Prettyman | 428/20 X |
| 2,911,748 | 11/1959 | Rodgers | 428/18 X |
| 3,674,612 | 7/1972 | Gehl, Jr. | 428/19 X |
| 3,704,366 | 11/1972 | Korb et al. | 428/18 X |
| 3,819,459 | 6/1974 | Wren | 428/18 X |
| 4,130,678 | 12/1978 | Higgins | 428/9 |
| 4,172,913 | 10/1979 | Ballah et al. | 428/20 X |
| 4,620,270 | 10/1986 | Laakso | 362/123 |
| 4,968,541 | 11/1990 | McCrory | 428/20 X |
| 4,979,085 | 12/1990 | Voorhees | 362/252 |
| 5,094,893 | 3/1992 | Snider | 428/20 X |
| 5,413,825 | 5/1995 | Chaiklin | 428/18 |

*Primary Examiner*—Henry F. Epstein
*Attorney, Agent, or Firm*—Edward M. Livingston, Esq.

[57] ABSTRACT

A telescopic decorative tree having a telescopic pole (1) has a tree trunk with a top (4) from which a plurality of guy lines (5) are extended downwardly and outwardly in Christmas tree shape to surface anchor means (6, 13). Christmas tree lights and other decorative items are suspended in strands (8) between the guy lines and pole attachments (9, 10, 11, 14, 15) on the telescopic pole. The pole attachments are preferably adjustable in vertical height to provide desired heights of inside ends of strands at the telescopic pole in relation to outside ends of the strands at the guy lines. Preferably, the strands are allowed to sag slightly for a desired aesthetic effect.

28 Claims, 2 Drawing Sheets

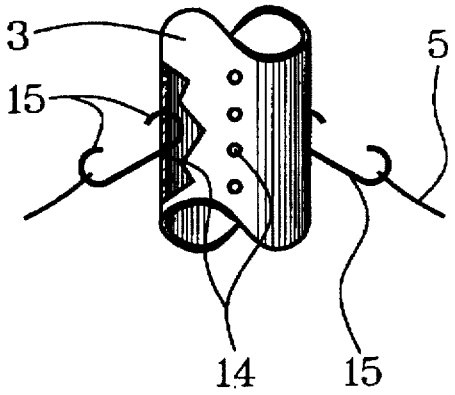
FIG. 3
FIG. 4
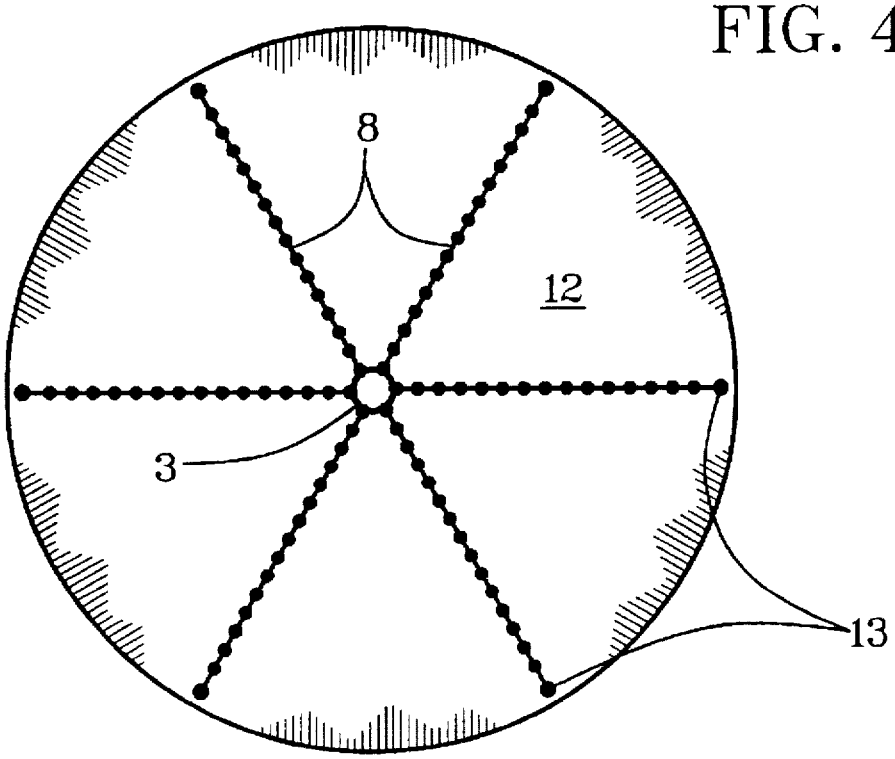
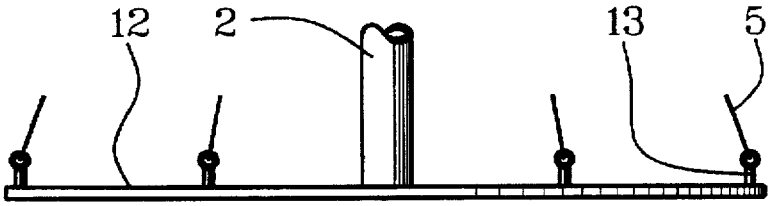
FIG. 5

TELESCOPIC DECORATIVE TREE

BACKGROUND OF THE INVENTION

This invention relates to artificial trees for Christmas decoration and other festive or display uses.

Various artificial Christmas trees and similarly-shaped display stands have been devised. None are known, however, to be conveniently telescopic for repeated use and storage in a manner taught by this invention.

Examples of different artificial trees are described in the following patent documents. U.S. Pat. No. 5,413,825, issued to Chaikin on May 9, 1995 described a collapsible artificial Christmas tree having a center pole around which a spiral coil of split plastic tubing to support lights, leaves and decorations was positioned. U.S. Pat. No. 5,094,893, issued to Snider on Mar. 10, 1992, described a pole with a large bottom portion for inserting in the ground and a top slimmer portion above a spoked hoop for a tree trunk supported by guy wires. U.S. Pat. No. 4,620,270, issued to Laakso on Oct. 28, 1986, described light strings extended between a large hoop at a base and a small hoop at a top of a pole to resemble a lighted Christmas tree. U.S. Pat. No. 4,130,678, issued to Higgins on Dec. 19, 1978, taught a conical garland on a mast to resemble a Christmas tree. U.S. Pat. No. 3,704,366, issued to Korb et al on Nov. 28, 1972, described tree lights extended between a top of a pole and anchored spokes at a bottom of the pole for a decorative outdoor Christmas tree. U.S. Pat. No. 3,674,612, issued to Gehl, Jr. on Jul. 4, 1972, described a layered display stand having circular shelves graduated in size from-top-to-bottom of a telescopic pole on a conical stand to simulate a Christmas tree. U.S. Pat. No. 2,289,680, issued to Prettyman on Jul. 14, 1942, described a support from which wires were extended laterally to hold ends of Christmas tree branch-like configurations that sagged between the wires and a central pole suspended from the support.

SUMMARY OF THE INVENTION

In light of expanding demand for artificial Christmas trees and displays resembling Christmas trees, objects of this invention are to provide a telescopic decorative tree which:

- Has a telescopic structure which can be set up and taken down quickly and easily;
- Can be stored in a small space between uses;
- Resembles a Christmas tree in form;
- Supports Christmas-light strands and other ornamentation in forms that resemble branches of Christmas trees;
- Is sturdy for outside use during windy and snowy conditions;
- Can be used indoors; and
- Can be manufactured in a variety of sizes and aesthetic features.

This invention accomplishes these and other objectives with a telescopic decorative tree having a telescopic pole as a tree trunk with a top from which a plurality of guy lines are extended downwardly and outwardly in Christmas tree shape to surface anchor means. Christmas tree lights and other decorative items are suspended in strands between the guy lines and pole attachments on the telescopic pole. The pole attachments are preferably adjustable in vertical height to provide desired heights of inside ends of strands at the telescopic pole in relation to outside ends of the strands at the guy lines. Preferably, the strands are allowed to sag slightly for a desired aesthetic effect.

The above and other objects, features and advantages of the present invention should become even more readily apparent to those skilled in the art upon a reading of the following detailed description in conjunction with the drawings wherein there is shown and described illustrative embodiments of the invention.

BRIEF DESCRIPTION OF DRAWINGS

This invention is described by appended claims in relation to description of a preferred embodiment with reference to the following drawings which are described briefly as follows:

FIG. 3 is an enlarged sectional side view of a portion of a telescopic pole having hook orifices with which strand hooks are attached to the telescopic pole;

FIG. 4 is a cross-sectional top view from cross section 4—4 in FIG. 1 showing radial strands above an optional base plate to which the telescopic pole and the guy lines are attached; and FIG. 5 is a sectional side view of the base plate with eyebolts as a base attachment means to which guy lines are attached at proximate an outside perimeter of the base plate.

DESCRIPTION OF PREFERRED EMBODIMENT

Figure 1:
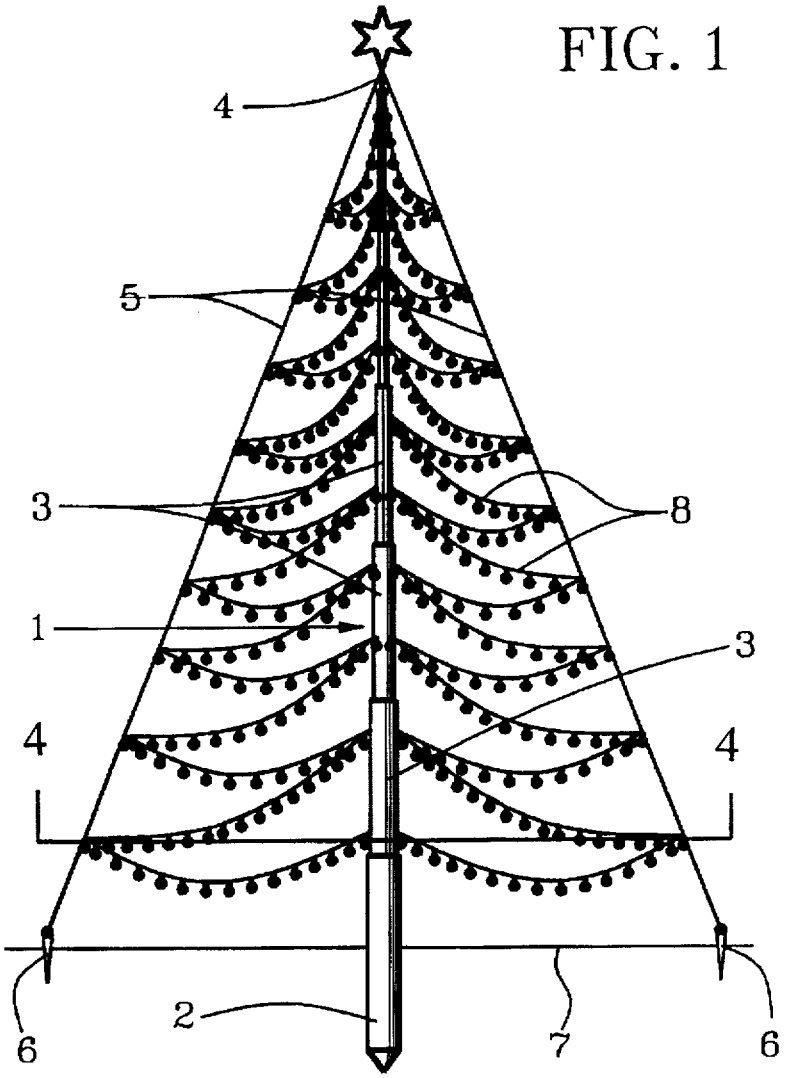
FIG. 1 is a side elevation view of an embodiment having ground stakes to which guy lines are attached.
Figure 2:
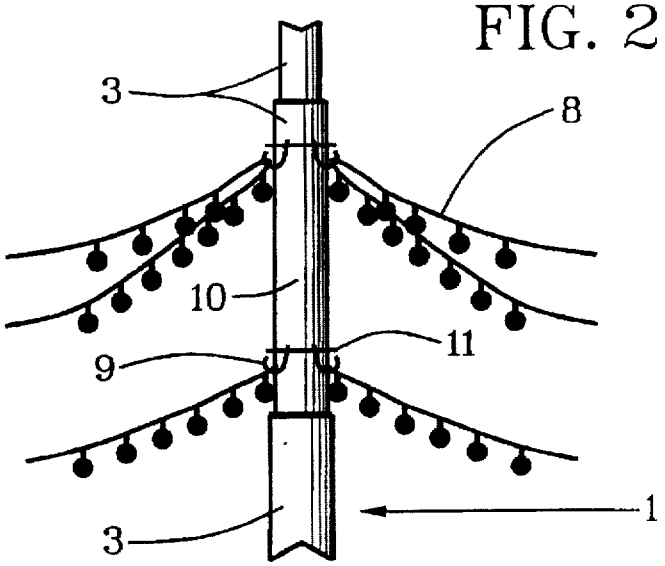
FIG. 2 is an enlarged sectional side view of a portion of a telescopic pole having vertical strings to which strands of Christmas tree lights and other ornamentation are attached.

Reference is made first to FIGS. 1–2. A telescopic pole 1 that is sized and shaped as a representation of a desired tree trunk has a base telescopic section 2 into which a design plurality of trunk sections 3 with successively smaller diametrical peripheries fit and from which the design plurality of trunk sections 3 are extendible telescopically intermediate the base telescopic section 2 and a top telescopic section 4. A plurality of guy lines 5 are extended from the top telescopic section 4 to stakes 6 in ground 7 as an optional type of surface anchor means surrounding the telescopic pole 1 which is embedded designedly into the ground 7. There can be a desired plurality of strands 8, depending on how tall the telescopic pole 1 is and on design preferences for density of the strands 8.

Strands 8 of Christmas tree lights and/or other ornamentation are extended radially intermediate the guy lines 5 and design pole attachments such as tie wraps 9 on vertical strings 10 that can be maintained in proximity to the telescopic pole 1 by such means as various types of attachment loops 11. Looseness of the strands 8 allows an aesthetic sag in the strands 8 to resemble upturned limbs of Christmas trees as depicted in FIG. 1.

Radial plurality of strands 8 extended from the telescopic pole 1 and matching guy lines can vary as desired. Too many strands 8 decreases the artistic appearance of limb-like sag of the strands 8, whereas, too few strands 8 gives the appearance of bareness. Two of six guy lines 5 and two of six tiers of strands 8 are shown in FIG. 1. In FIG. 4, six guy lines 5 and six tiers of strands 8 are shown.

Referring to FIGS. 3–5, the surface anchor means can be a base plate 12 to which the telescopic pole 1 is attached centrally and base attachment means such as an eyebolt 13 to which the guy lines 5 are attached. The pole attachments can be attachment orifices 14 that are sized, shaped and positioned to receive strand attachments 15 in perimeters of the trunk sections 3. With a sufficient plurality of the attachment orifices 14, heights of the strands can be adjusted as desired.

A snap fastener illustrated or a simple C-hook are representative of a wide variety of strand attachments 15 and matching attachment orifices 14 that are foreseeable. The attachment orifices 14 can be used doubly as bolt orifices for maintaining the telescopic pole 1 in an extended mode.

The base plate 12 is primarily for indoor use but can be used outdoors as well. Construction of the base plate 12 can be like a disk as shown or spoked like bases of tables and other standing objects. The telescopic pole 1 can be used alternatively with or without the base plate 12 and with either pole attachment means.

The guy lines 5 can be plastic or any other material. Plastic-covered wire cable is one alternative. Preferably, they are dark colored like the nights in which they will be most effective or translucent to avoid visibility. Various types of attachments can be employed for attaching outside portions of strands 8 to the guy lines 5.

A new and useful telescopic decorative tree having been described, all such modifications, adaptations, substitutions of equivalents, combinations of parts, pluralities of parts, applications and forms thereof as described by the following claims are included in this invention.

Having thus described my invention, I claim:

1. A telescopic decorative tree comprising:

a telescopic pole sized and shaped as a representation of a desired tree trunk and having a base telescopic section into which a design plurality of trunk sections with successively smaller diametrical peripheries fit and from which the design plurality of trunk sections with successively smaller diametrical peripheries are extendible telescopically intermediate the base telescopic section and a top telescopic section;

a plurality of guy lines extended from the top telescopic section in an extended mode to surface anchor means;

a desired plurality of pole attachments positioned in design separation vertically on the telescopic pole; and a desired plurality of strands of decorative items extendible intermediate desired pole attachments at desired telescopically extended positions and desired guy lines at desired positions.

2. A telescopic decorative tree as described in claim 1 wherein:

surface anchor means are stakes driven into ground surrounding the telescopic pole.

3. A telescopic decorative tree as described in claim 1 wherein:

surface anchor means are a base plate to which the base telescopic section of the telescopic pole is attached centrally and base attachment means proximate an outside perimeter of the base plate.

4. A telescopic decorative tree as described in claim 1 wherein:

the guy lines are plastic.

5. A telescopic decorative tree as described in claim 1 wherein:

the guy lines are wire cable.

6. A telescopic decorative tree as described in claim 5 wherein:

the wire cable is coated with plastic material.

7. A telescopic decorative tree as described in claim 1 wherein:

the pole attachments are vertical strings positioned about the telescopic pole and having hooks to which the strands of decorative items are attached.

8. A telescopic decorative tree as described in claim 1 wherein:

the pole attachments are attachment orifices in perimeters of the trunk sections; and the attachment orifices are sized, shaped and positioned to receive strand attachments on inside ends of the strands of decorative items.

9. A telescopic decorative tree as described in claim 1 wherein:

the strands of decorative items are Christmas tree light strands having design pluralities of select Christmas tree lights.

10. A telescopic decorative tree as described in claim 9 wherein:

the Christmas tree light strands are designed for attachment of additional decorative items to the Christmas tree light strands.

11. A telescopic decorative tree as described in claim 10 wherein:

the strands of decorative items extended intermediate desired pole attachments and desired guy lines at desired heights have sufficient length intermediate the telescopic pole and the guy lines to allow a desired sag of the strands of decorative items, such that the strands of decorative items can be made to resemble Christmas tree limbs with outside ends that are upturned.

12. A telescopic decorative tree as described in claim 1 wherein:

the strands of decorative items extended intermediate desired pole attachments and desired guy lines at desired heights have sufficient length intermediate the telescopic pole and the guy lines to allow a desired sag of the strands of decorative items, such that the strands of decorative items can be made to resemble Christmas tree limbs with outside ends that are upturned.

13. A telescopic decorative tree comprising:

a telescopic pole sized and shaped as a representation of a desired tree trunk and having a base telescopic section into which a design plurality of trunk sections with successively smaller diametrical peripheries fit and from which the design plurality of trunk sections with successively smaller diametrical peripheries are extendible telescopically intermediate the base telescopic section and a top telescopic section;

a plurality of guy lines extended from the top telescopic section in an extended mode to surface anchor means;

the surface anchor means being stakes driven into ground surrounding the telescopic pole;

a desired plurality of pole attachments positioned in design separation vertically on the telescopic pole;

the pole attachments being vertical strings positioned about the telescopic pole and having hooks to which the strands of decorative items are attached; and a desired plurality of strands of decorative items extendible intermediate desired pole attachments at desired telescopically extended positions and desired guy lines at desired positions.

14. A telescopic decorative tree as described in claim 13 wherein:

the guy lines are plastic.

15. A telescopic decorative tree as described in claim 13 wherein:

the guy lines are wire cable.

16. A telescopic decorative tree as described in claim 15 wherein:

the wire cable is coated with plastic material.

17. A telescopic decorative tree as described in claim 13 wherein:

the strands of decorative items are Christmas tree light strands having design pluralities of select Christmas tree lights.

18. A telescopic decorative tree as described in claim 17 wherein:

the Christmas tree light strands are designed for attachment of additional decorative items to the Christmas tree light strands.

19. A telescopic decorative tree as described in claim 18 wherein:

the strands of decorative items extended intermediate desired pole attachments and desired guy lines at desired heights have sufficient length intermediate the telescopic pole and the guy lines to allow a desired sag of the strands of decorative items, such that the strands of decorative items can be made to resemble Christmas tree limbs with outside ends that are upturned.

20. A telescopic decorative tree as described in claim 13 wherein:

the strands of decorative items extended intermediate desired pole attachments and desired guy lines at desired heights have sufficient length intermediate the telescopic pole and the guy lines to allow a desired sag of the strands of decorative items, such that the strands of decorative items can be made to resemble Christmas tree limbs with outside ends that are upturned.

21. A telescopic decorative tree comprising:

a telescopic pole sized and shaped as a representation of a desired tree trunk and having a base telescopic section into which a design plurality of trunk sections with successively smaller diametrical peripheries fit and from which the design plurality of trunk sections with successively smaller diametrical peripheries are extendible telescopically intermediate the base telescopic section and a top telescopic section;

a plurality of guy lines extended from the top telescopic section in an extended mode to surface anchor means;

surface anchor means being a base plate to which the base telescopic section of the telescopic pole is attached centrally and base attachment means proximate an outside perimeter of the base plate;

a desired plurality of pole attachments positioned in design separation vertically on the telescopic pole;

the pole attachments being attachment orifices in perimeters of the trunk sections;

the attachment orifices being sized, shaped and positioned to receive strand attachments on inside ends of the strands of decorative items; and a desired plurality of strands of decorative items extendible intermediate desired pole attachments at desired telescopically extended positions and desired guy lines at desired positions.

22. A telescopic decorative tree as described in claim 21 wherein:

the guy lines are plastic.

23. A telescopic decorative tree as described in claim 21 wherein:

the guy lines are wire cable.

24. A telescopic decorative tree as described in claim 23 wherein:

the wire cable is coated with plastic material.

25. A telescopic decorative tree as described in claim 21 wherein:

the strands of decorative items are Christmas tree light strands having design pluralities of select Christmas tree lights.

26. A telescopic decorative tree as described in claim 25 wherein:

the Christmas tree light strands are designed for attachment of additional decorative items to the Christmas tree light strands.

27. A telescopic decorative tree as described in claim 26 wherein:

the strands of decorative items extended intermediate desired pole attachments and desired guy lines at desired heights have sufficient length intermediate the telescopic pole and the guy lines to allow a desired sag of the strands of decorative items, such that the strands of decorative items can be made to resemble Christmas tree limbs with outside ends that are upturned.

28. A telescopic decorative tree as described in claim 21 wherein:

the strands of decorative items extended intermediate desired pole attachments and desired guy lines at desired heights have sufficient length intermediate the telescopic pole and the guy lines to allow a desired sag of the strands of decorative items, such that the strands of decorative items can be made to resemble Christmas tree limbs with outside ends that are upturned.

* * * * *